US006684581B2

(12) United States Patent
Robinson et al.

(10) Patent No.: US 6,684,581 B2
(45) Date of Patent: Feb. 3, 2004

(54) ROLL TYPE ROOF RIDGE VENTILATOR AND ASSOCIATED METHOD

(75) Inventors: Larry D. Robinson, Taylorsville, MS (US); Derick Dry, Laurel, MS (US)

(73) Assignee: Solar Group, Inc., Taylorsville, MS (US)

( * ) Notice: Subject to any disclaimer, the term of this patent is extended or adjusted under 35 U.S.C. 154(b) by 217 days.

(21) Appl. No.: 09/772,611

(22) Filed: Jan. 30, 2001

(65) Prior Publication Data

US 2002/0100232 A1 Aug. 1, 2002

(51) Int. Cl.[7] ..... E04B 7/00; E04H 12/28

(52) U.S. Cl. ..... 52/198; 52/11; 52/41; 52/57; 52/199; 454/365; 454/366; 454/367

(58) Field of Search ..... 52/198, 199, 57, 52/516, 517, 519–532, 11, 22, 41, 556; 454/364, 365, 366, 367

(56) References Cited

U.S. PATENT DOCUMENTS

| | | | | |
|---|---|---|---|---|
| 4,554,862 A | | 11/1985 | Wolfert | |
| 4,803,813 A | | 2/1989 | Fiterman | |
| 4,924,761 A | * | 5/1990 | MacLeod et al. | 454/365 |
| 4,957,037 A | | 9/1990 | Tubbesing et al. | |
| 5,094,041 A | | 3/1992 | Kasner et al. | |
| 5,095,810 A | | 3/1992 | Robinson | |
| 5,149,301 A | | 9/1992 | Gates | |
| 5,457,920 A | | 10/1995 | Waltz | |
| 5,458,538 A | * | 10/1995 | MacLeod et al. | 454/365 |
| 5,772,502 A | | 6/1998 | Smith | |
| 6,128,869 A | * | 10/2000 | Brotherton et al. | 52/198 |
| 6,233,887 B1 | * | 5/2001 | Smith | 52/199 |
| 6,277,024 B1 | * | 8/2001 | Coulton | 454/365 |
| 6,450,882 B1 | * | 9/2002 | Morris et al. | 454/365 |
| 6,482,084 B2 | * | 11/2002 | Hansen | 454/365 |

* cited by examiner

*Primary Examiner*—Jeanette Chapman
(74) *Attorney, Agent, or Firm*—Brij K.. Agarwal; Eckert Seamans Cherin & Mellott, LLC

(57) ABSTRACT

A rollable ridge vent includes an elongated panel having a pair of opposite ends and a pair of opposite sides, a plurality of first baffles depending from the panel and arranged to form a pair of first rows adjacent the sides of the panel, a plurality of second baffles depending from the panel and arranged to form a pair of second rows adjacent and at least partially overlapping the first baffles, with the first and second baffles being spaced from one another to provide a plurality of drainage spaces therebetween, a plurality of third baffles depending from the panel that are arranged in a sinusoidal pattern and disposed between the second rows of second baffles, and in which the ridge vent further includes a seal member at each end of the panel, with a generally triangular dowel formed in one of the seal members and a lug having a generally triangular socket with a constricted throat formed in the opposite seal member, the dowels and sockets being co-operable with corresponding dowels and sockets formed on similar ridge vent members. A rollable ridge vent system is also disclosed wherein a plurality of ridge vent members are mounted over an opening formed in a peak of a roof. A method of installing a ridge vent system over an opening formed in a roof is further disclosed.

54 Claims, 8 Drawing Sheets

ROLL TYPE ROOF RIDGE VENTILATOR AND ASSOCIATED METHOD

BACKGROUND OF THE INVENTION

1. Field of the Invention

The present invention relates generally to roof ventilation systems for buildings and, more particularly, to a ridge vent system. Specifically, the present invention relates to a roof ridge ventilation system and associated method in which the ridge vent members are rolled for ease of handling and packaging.

2. Description of the Related Art

It is generally known that a roof ventilation system is an important component of a building to provide ventilation to the attic region that is between the roof and the occupied regions of the building. More specifically, during the summer months the sunlight incident on a roof and the relatively warmer ambient temperatures can raise the air temperature within the attic to over 150° F., and such elevated attic temperatures may not fall significantly even at night. Such elevated temperatures can increase cooling costs and can have a deleterious effect on the roof itself. During the winter months, daily activities within the occupied regions of the structure such as cooking and bathing, an even a person's presence inside the structure, cause moisture-laden warm air to convectively rise vertically upward into the attic which is of a relatively lower temperature than the occupied regions. The moisture-laden air then cools within the attic, which can result in the condensation of water droplets on the interior surfaces of the attic. Such moisture droplets likewise have a deleterious effect on the roof and the building itself. It is thus known to provide a ventilation system to permit air within the attic to circulate in an order to overcome the aforementioned deleterious effects.

Roof ventilation systems can broadly be stated to include active and passive ventilators. Among active systems are the fan systems that provide forced-air ventilation to the attic. Among the passive systems are roof ridge ventilators that provide openings through which the air within the attic can convectively flow to provide ventilation. Ridge ventilation systems must provide a beneficial level of ventilation to the attic yet must be configured to resist the entry of precipitation, insects, foreign matter, and the like into the attic.

Roof ridge ventilators typically are coveringly disposed over an elongated opening that is formed in a roof and that extends along the peak of the roof, with the opening typically being in the range of approximately 4–8 inches in width and running along a substantial portion of the roof peak. Such openings typically do not extend to the ends of the peak for various structural and functional reasons, as well as other reasons. Such roof ridge ventilators typically function in cooperation with air inlet openings that are typically formed in a lower region of the roof that is generally protected from precipitation, such as the eaves.

In use, the air temperature within the attic is nearly always higher than the ambient temperature of the air surrounding the building. As such, the relatively warmer attic air convectively rises and flows out of the opening formed at the peak of the roof. Simultaneously therewith, ambient air flows into the attic through the air inlet openings to take the place of the relatively warmer air that is flowing upward and out of the attic through the opening at the peak.

In order to provide ventilation to the attic yet resist the entry of precipitation, insects, foreign matter, and the like into the attic, roof ridge ventilators typically include openings that are configured in conjunction with baffles to permit the free flow of air while blocking the direct entry of precipitation or insects. Some roof ridge ventilators may additionally or alternatively include one or more layers of fiber or foam to achieve a similar objective. In recent years, ridge vents that employ openings and baffles have become more popular due to their ability to be more economically manufactured and installed. While most roof ridge vents of the type having baffles and openings have been generally effective for their intended purposes, such ridge vents have not, however, been without limitation.

Roof ridge vent systems must be configured to conform to the sloped roof extending on each side of the roof ridge opening. Moreover, such roof ridge vents must have at least a nominal level of crush resistance to permit the occasional person to walk across the ridge vent and accommodate the weight of accumulated snow and ice and the impact of the occasional falling tree limb and the like. While it has been know to manufacture such roof ridge vents out of aluminum and other relatively rigid materials, improved ridge vents have recently been developed that are made of plastic materials and that are nominally flexible along a longitudinal axis thereof in order to permit the ridge vent to conform to the sloped sides of the roof on opposite sides of the peak opening. Plastic ridge vents typically include a plurality of baffles and/or other structures that depend from a common panel and that serve both the functions of resisting entry of precipitation, insects, foreign matter, and the like, as well as providing support structures that retain the panel away from the roof and that resist crushing of the ridge vent.

Despite such ridge vents being nominally flexible along a longitudinal axis thereof, such ridge vents nevertheless are too rigid to be rolled lengthwise, and rather must be sold in generally rigid elongated sections. A plurality of such elongated sections are typically joined with one another in an end-two-end fashion to cover openings that are longer than the individual sections of the ridge vent material.

The installation of such a ridge vent system is labor intensive since a worker typically must remove tools such as hammers and nails from his or her hands in order to grasp and position each relatively rigid section of ridge vent material, and must then take up the hammer and nails to continue installation of the ridge vent system. The installation of each section of ridge vent material thus requires substantial labor. Moreover, the sections of ridge vent material can only be of a length that can be easily transported and handled by human beings, which may typically be of a length only on the order of 4–10 feet.

It is thus desired to provide an improved ridge vent system that can be easily installed by a worker and that reduces the time that must be spent by a worker in joining large numbers of discrete sections of ridge vent material to one another, as well as reducing the time spent replacing hammers and nails into tool belts and taking them back up after the positioning of each section of ridge vent material. Such a system preferably will include a relatively longer length of ridge vent material that is resiliently deformed or rolled into a roll that can be easily handled by a worker and that requires relatively fewer joining steps to cover the openings in the peaks of roofs. Such a system preferably will also incorporate structures or other enhancements that take advantage of naturally occurring wind to increase ventilation.

SUMMARY OF THE INVENTION

In accordance with the foregoing, a rollable ridge vent includes an elongated panel having a pair of opposite ends and a pair of opposite sides, with a plurality of first, second, and third baffles depending from the panel. The first baffles are arranged to form a pair of first rows adjacent the sides of the panel, and the second baffles are arranged to form a pair of second rows adjacent, inward of, and at least partially overlapping the first baffles. The first and second baffles are spaced from one another to provide a plurality of drainage spaces therebetween. The third baffles are arranged in a sinusoidal pattern between the second rows of second baffles. The ridge vent further includes a seal member at each end of the panel. A pair of generally triangular dowels are formed in one of the seal members, and a pair of lugs that each have a generally triangular socket with a constricted throat are formed in the opposite seal member, with the dowels and sockets of the ridge vent being co-operable with corresponding dowels and sockets formed on similar ridge vents to provide secure inter-engagement therebetween. A rollable ridge vent system is also disclosed wherein a plurality of ridge vent members are mounted over an opening formed in a peak of a roof. A method of installing a ridge vent system over an opening formed in a roof is further disclosed.

An object of the present invention is thus to provide a ridge vent system that can be resiliently deformed to form a roll.

Another object of the present invention is to provide a ridge vent that resists the entry of precipitation, insects, foreign matter, and the like, into an opening at the peak of a roof, yet that permits ventilation through the opening.

Another object of the present invention is to provide a ridge vent having a plurality of baffles that resist the entry of precipitation, insects, foreign matter, and the like, that provide strength and support to the ridge vent, and that permit drainage of moisture from underneath the ridge vent.

Another object of the present invention is to provide a ridge vent having a plurality of first and second baffles extending along each side of the ridge vent and at least partially overlapping one another to resist the entry of precipitation, insects, foreign matter, and the like, to permit drainage of moisture therethrough, and that permit the ridge vent to be resiliently deformed or rolled into a roll.

Another object of the present invention is to provide a ridge vent having an attachment system in the form of a generally triangular dowel that is slidably receivable in a correspondingly shaped socket with a constricted throat to provide secure inter-engagement between the ridge vent and another similar ridge vent.

Another object of the present invention is to provide a ridge vent system including one or more ridge vent members, with each ridge vent member having a seal member disposed at each end thereof, with the seal members each including at least a pair of seal plates that at least partially overlap one another at all times prior to and subsequent to installation of the ridge vent on a roof.

Another object of the present invention is to provide a ridge vent having angled lips extending outwardly therefrom along the sides of the ridge vent that deflect wind flowing over the ridge vent to enhance ventilation of the attic space.

Another object of the present invention is to provide a ridge vent having first and second baffles extending along each side thereof that at least partially overlap one another and that are each of a generally outwardly facing concave configuration.

One embodiment of the present invention, a ridge vent structured to be mounted over an opening formed in a roof can be broadly stated as including an elongated panel having a first end and a second end and having a pair of opposed sides. The panel has an upper surface and a lower surface, with the lower surface being structured to face toward the roof. A plurality of first baffles depend from the lower surface of the panel, with the first baffles being spaced from one another and arranged to form a pair of first rows adjacent the sides of the panel. A plurality of second baffles depend from the lower surface of the panel, with the second baffles being spaced from one another and arranged to form a pair of second rows disposed adjacent the first rows. The second baffles alternate with and at least partially overlap the first baffles along each side of the panel, with the first and second baffles being spaced from one another to provide a plurality of drainage spaces between the first and second baffles, and with the second rows being disposed between the first rows. The first and second baffles each have an outwardly facing generally concave configuration. A plurality of third baffles depend from the lower surface of the panel, with the third baffles being disposed between the pair of second rows.

In another aspect of the present invention, a ridge vent structured to be mounted over an opening formed in a roof can be broadly stated as including an elongated panel having a first end and a second end and having a pair of opposed sides. The panel has an upper surface and a lower surface, with the lower surface being structured to face toward the roof. A plurality of first baffles depend from the lower surface of the panel, with the first baffles being spaced from one another and arranged to form a pair of first rows adjacent the sides of the panel. A plurality of second baffles depend from the lower surface of the panel, with the second baffles being spaced from one another and arranged to form a pair of second rows disposed adjacent the first rows. The second baffles alternate with and at least partially overlap the first baffles along each side of the panel, with the first and second baffles being spaced from one another to provide a plurality of drainage spaces between the first and second baffles, and with the second rows being disposed between the first rows. The first end includes a first lug having a first socket with a constricted throat, the second end includes a first dowel, and the first dowel is structured to be receivable in a second socket of a second lug of a similar second ridge vent to provide secure inter-engagement with the second ridge vent.

In yet another aspect of the present invention, a ridge vent structured to be mounted over an opening formed in a roof can be broadly stated as including an elongated panel having a first end and a second end and having a pair of opposed sides. The panel has an upper surface and a lower surface, with the lower surface being structured to face toward the roof. A plurality of first baffles depend from the lower surface of the panel, with the first baffles being spaced from one another and arranged to form a pair of first rows adjacent the sides of the panel. A plurality of second baffles depend from the lower surface of the panel, with the second baffles being spaced from one another and arranged to form a pair of second rows disposed adjacent the first rows. The second baffles alternate with and at least partially overlap the first baffles along each side of the panel, with the first and second baffles being spaced from one another to provide a plurality of drainage spaces between the first and second baffles, and with the second rows being disposed between the first rows. A pair of seal members depend from the lower surface of the panel at the opposite ends of the panel, with each seal member including at least a pair of seal plates that at least partially overlap one another when the panel is in the relaxed position, and the ridge vent is structured to be lengthwise resiliently deformable to form a roll.

In another aspect of the present invention, a ridge vent system mounted over an opening formed in a peak of a roof can be generally stated as including at least a first ridge vent member and a second ridge vent member connected with one another, with the first and second ridge vent members each including an elongated panel having a first end and a second end and a pair of opposed sides. Each panel includes an upper surface and a lower surface, with the lower surface facing toward the roof. A plurality of first baffles depend from the lower surface of each panel, with the first baffles being spaced from one another and arranged to form a pair of first rows adjacent the sides of the panel. A plurality of second baffles depending from the lower surface of each panel, with the second baffles being spaced from one another and arranged to form a pair of second rows disposed adjacent the first rows, the second baffles alternating with and at least partially overlapping the first baffles along each side of the panel, and the first and second baffles being spaced from one another to provide a plurality of drainage spaces between the first and second baffles, the second rows being disposed between the first rows. Each first end includes a first lug having a generally triangular socket with a constricted throat, each second end includes at least a first generally triangular dowel, and the first dowel of the first ridge vent member is received in the first socket of the second ridge vent member to securely inter-engage the first and second ridge vent members.

In still another aspect of the present invention, a method of installing a ridge vent system over an opening formed in a roof can be generally stated as including the steps of resiliently deforming a first ridge vent member from a rolled condition to a generally unrolled condition, the ridge vent member including an elongated panel having a first end and a second end and a pair of opposed sides, the panel having an upper surface and a lower surface, the lower surface being structured to face toward the roof, a plurality of first baffles depending from the lower surface of the panel, the first baffles being spaced from one another and arranged to form a pair of first rows adjacent the sides of the panel, a plurality of second baffles depending from the lower surface of the panel, the second baffles being spaced from one another and arranged to form a pair of second rows adjacent the first rows, the second baffles alternating with and at least partially overlapping the first baffles along each side of the panel, the first and second baffles being spaced from one another to provide a plurality of drainage spaces between the first and second baffles, the second rows being disposed between the first rows, the first and second baffles each having an outwardly facing generally concave configuration, and a plurality of third baffles depending from the lower surface of the panel, the third baffles being disposed between the pair of second rows, securing the first ridge vent member to the roof, connecting the first ridge vent member with a similar second ridge vent member by receiving a generally triangular first dowel disposed on one of the first and second ridge vent members in a generally triangular socket of a first lug disposed on the other of the first and second ridge vent members and by sliding one of the first and second ridge vents with respect to the other of the first and second ridge vents in a direction substantially perpendicular to the panels of the first and second ridge vents in the vicinity of the first dowel and first lug, resiliently deforming the second ridge vent member from a rolled condition to a generally unrolled condition, and securing the second ridge vent member to the roof.

BRIEF DESCRIPTION OF THE DRAWINGS

A further understanding of the invention can be gained from the following description of the preferred embodiment when read in conjunction with the accompanying drawings in which.

Similar numerals refer to similar parts throughout the specification.

DESCRIPTION OF THE PREFERRED EMBODIMENT

A ridge vent 4 in accordance with the present invention is indicated generally in FIGS. 1–11. The ridge vent 4 is configured to be mounted over an opening 8 (FIGS. 10 and 11) that is formed in the peak of a roof 12 of a building (not shown.) As used herein, the terms "building" and "structure" are used interchangeably and refer to any type of building, structure, or dwelling, whether commercial, industrial, or residential, that includes a roof. The ridge vent 4 is advantageously designed to allow and promote ventilation of the air within the attic, yet resist the entry of precipitation, insects, foreign matter, and the like into the attic through the opening 8. As used herein, the term "attic" refers to an area within the building or structure that is generally between the roof and the occupied regions, and need not be an area that is enclosed or otherwise separate from the occupied regions.

Figures 9, 12:
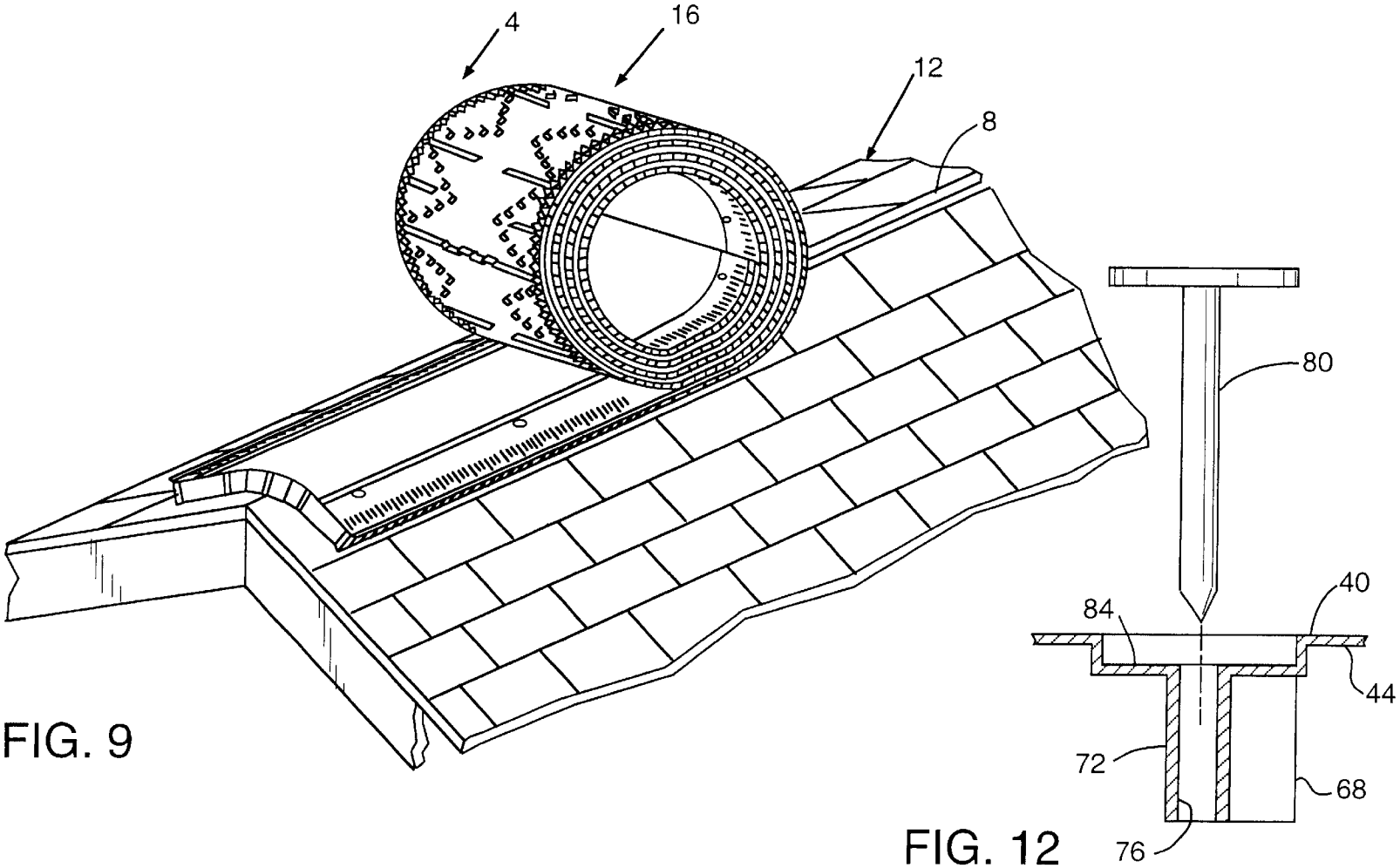
FIG. 9 is a perspective view of the ridge vent resiliently deformed to form a roll and being at least partially unrolled at the peak of a roof during installation of a ridge vent system thereon.
FIG. 12 is a sectional view as taken along line 12—12 of FIG. 8.
Figure 10:
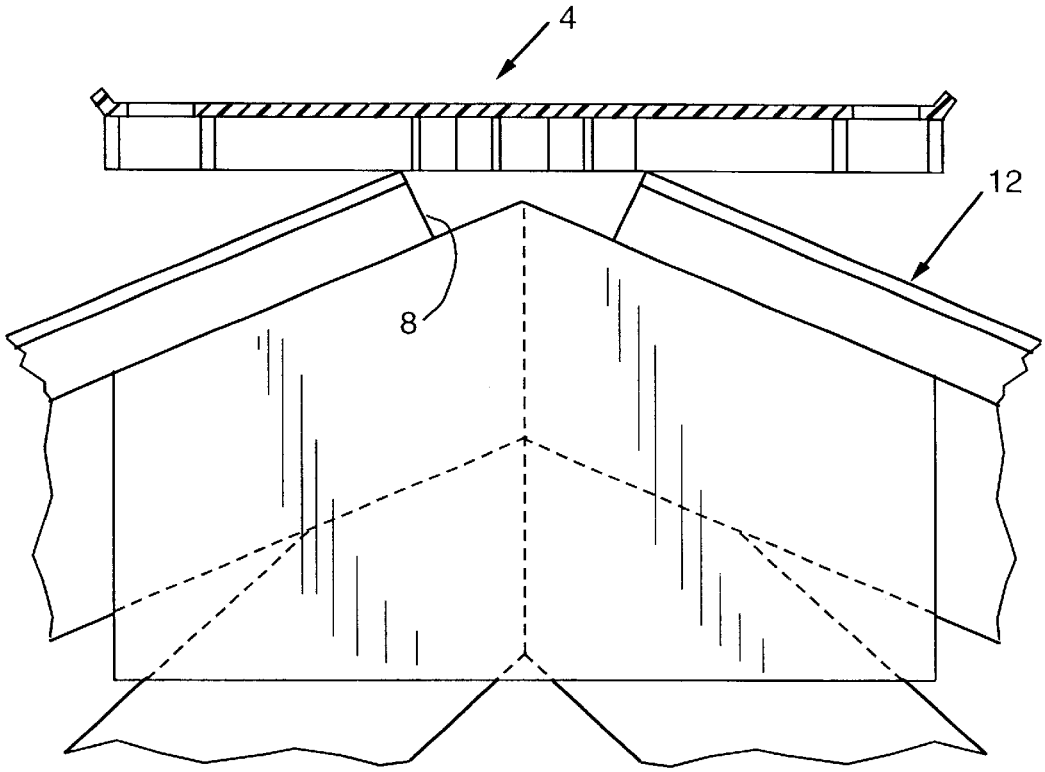
FIG. 10 is a sectional view of the roof with the ridge vent disposed thereon in a relaxed position.

As is best shown in FIG. 9, the ridge vent 4 is further advantageously configured to be resiliently deformed or rolled lengthwise into a roll 16, which facilitates handling, transportation, and installation of the ridge vent 4 on the roof 12, as would be set forth more fully below. Moreover, the ridge vent 4 can be resiliently deformed or flexed about a longitudinal axis 18 thereof between a relaxed position (FIG. 10) in which the ridge vent 4 is substantially flat across an axis transverse to the longitudinal axis 18 and an installed position (FIG. 11) in which the ridge vent 4 is angled to conform substantially to the sloped sides of the roof 12.

The ability of the ridge vent 4 to be resiliently deformed or flexed is due both to the advantageous design thereof that will be set forth more fully below as well as the selection of the material out of which the ridge vent 4 is manufactured. Moreover, and as will be set forth more fully below, the ability of the ridge vent 4 to be resiliently deformed or rolled lengthwise into the roll 16 results from the specific material of the ridge vent 4, but also advantageously results from configuring the ridge vent 4 such that a plurality of projections that depend from a panel of the ridge vent 4 each extend only a short longitudinal distance along the panel, and thus do not resist lengthwise resilient deformation of the ridge vent 4 to as great an extent as would smaller numbers of projections that each extend a relatively greater longitudinal distance along the ridge vent.

The ridge vent 4 can be manufactured out of any of a wide variety of resins and other plastic-type materials. More particularly, in one embodiment of the present invention the ridge vent 4 is manufactured out of a polypropylene copolymer material, although in other embodiments the ridge vent 4 may be manufactured out of materials such as a low density polyethylene (LDPE) or other materials. Moreover, the material out of which the ridge vent 4 is manufactured may additionally include a butadiene modifier to give the ridge vent 4 further desirable resilient properties. The specific material preferably will be selected to provide a desirable mix of properties that may include resistance to cold weather cracking, resistance melting during hot weather, resistance to degradation from ultraviolet (UV) light, and resistance to fracturing, such as when hail or tree branches may fall on the installed ridge vent 4, or when the ridge vent 4 is stepped upon. It thus can be seen that the ridge vent 4 can be made out of virtually any material that provides a desirable mix of weather resistant properties and resilience.

The ridge vent 4 may also be manufactured in different colors that are suited to the specific needs of the particular application. In one embodiment of the ridge vent 4, the material out of which the ridge vent 4 is manufactured is generally black in color, with such black coloring being provided in pertinent part by carbon black which advantageously is a strong UV inhibitor or absorber that resists degradation of the ridge vent 4 by UV light. If other colors than black are desired, the material out of which the differently colored ridge vent 4 will be manufactured preferably will include a UV "package" that will provide appropriate UV inhibitors to similarly protect the ridge vent from degradation due to UV light.

The ridge vent 4 can be manufactured in any of a wide variety of fashions such as various types of molding, casting, and other methodologies. The ridge vent 4 is particularly appropriately manufactured via injection molding, although other and additional manufacturing processes may be employed without departing from the concept of the present invention.

The ridge vent 4 includes an elongated and substantially rectangular panel 20 having a first end 24 and a second end 28 opposite one another, and further having a first side 32 and a second side 36 opposite one another. The panel 20 preferably has a thickness in the range of about 1/32–3/32 inch, an most preferably, is approximately 1/16 inch in thickness, although such dimensions may differ depending upon the specific material out of which the ridge vent 4 is manufactured as well as other factors. The panel 20 also has a width in the range of about 12 –16 inches, and preferably is approximately 14½ inches in width. The panel 20, and thus the ridge vent 4, can be of varying lengths as long as twenty feet and longer. As will be set forth more fully below, rolls 16 of the ridge vent 4 that are twenty feet in length and longer are easily handled by an individual worker since the ridge vent 4 is manufactured out of a relatively lightweight material and is advantageously resiliently deformed into the roll 16 which can easily be manipulated by an individual worker.

The panel 20 includes an upper surface 40 and an opposite lower surface 44. When installed, the lower surface 44 faces toward the roof 12, and the upper surface 40 faces toward the atmosphere.

The panel 20 is also formed with a plurality of elongated apertures 48 that are oriented transversely on the panel 20 and are spaced from one another along each of the first and second sides 32 and 36. It can be seen that the apertures 48 are of two different lengths, as will be set forth more fully below.

A plurality of first baffles 52 that depend from the lower surface 44 of the panel 20 are spaced from one another and are arranged along a first row 56 extending adjacent each of the first and second sides 32 and 36. Similarly, a plurality of second baffles 60 that depend from the lower surface 44 of the panel 20 are spaced from one another and are arranged along a second row 64 that extends adjacent each first row 56 of the first baffles 52.

Figure 6:
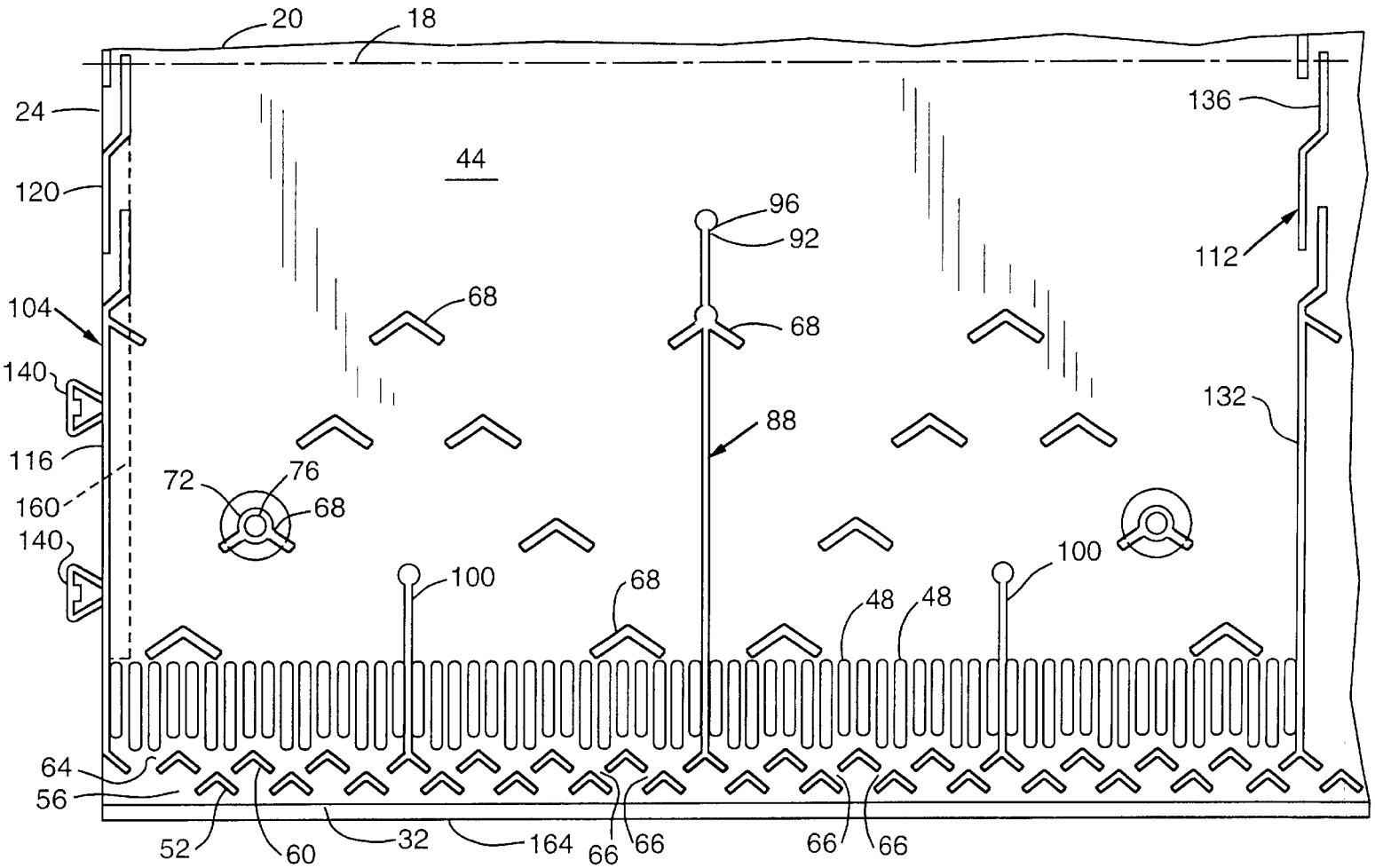
FIG. 6 is an enlarged view of a portion of FIG. 3.

As is best shown in FIG. 6, the first and second baffles 52 and 60 at least partially overlap one another, yet are spaced from one another to provide a drainage space 66 between each adjacent first and second baffle 52 and 60. As will be set forth more fully below, the first and second baffles 52 and 60 advantageously at least partially overlap one another to resist the entry of precipitation, insects, foreign matter, and the like, yet are spaced to provide the drainage spaces 66 which permit the drainage of moisture therepast.

A plurality of third baffles 68 that depend from the lower surface 44 of the panel 20 are arranged in a generally undulating or sinusoidal pattern along the panel 20. As can be seen in FIG. 6, such a generally undulating or sinusoidal arrangement causes the third baffles 68 to at least partially overlap one another to further resist the entry of precipitation, insects, foreign matter, and the like, yet permit the drainage of moisture therepast in an outward direction away from the opening 8 and away from the ridge vent 4. The third baffles 68 also resist the entry of water or moisture that may enter the ridge vent 4 and be driven by wind through the apertures 48.

The first, second, and third baffles 52, 60, and 68 are substantially V-shaped in cross-section and thus have a generally concave configuration that faces outwardly of the ridge vent 4. As used herein, the term "concave" refers to a surface on which neighboring normals to the surface converge, and thus refers to angular surfaces as well as arcuate surfaces. In this regard, it is understood that in alternate embodiments the first, second, and third baffles 52, 60, and 68 could be of an arcuate or other configuration instead of being V-shaped without departing from the concept of the present invention.

As can further be seen in FIG. 6, some of the third baffles 68 are formed on a fastener boss 72 that depends from the lower surface 44 of the panel 20 and is formed with a substantially cylindrical fastener-receiving hole 76 that is structured to receive a fastener 80 (FIG. 11) therein. As can further be understood from FIG. 11, the panel 20 is formed with a counterbored depression 84 extending into the upper surface 40 thereof that is axially aligned with each fastener-receiving hole 76 and that is structured to receive a flared head of a fastener 80 therein.

Some of the third baffles 68 are similarly formed on a plurality of first stiffening ribs 88 that each extend inwardly from one of the second baffles 60 and that terminate at a free end 92 that is opposite the second baffle 60 and inward thereof. More specifically, the first stiffening rib 88 depicted in FIG. 6 terminates at a generally cylindrical ejection peg 96 that is provided to assist in ejecting the ridge vent 4 from its mold (not shown) during the injection molding process thereof. Similar ejection pegs 96 are formed on other parts of the ridge vent 4 for similar facilitation of the ejection process and it is understood that such ejection pegs may be of different arrangements and configurations and form no part of the present invention. It is further understood from FIG. 6 that a plurality of second stiffening ribs 100 depend from the lower surface 44 of the panel 20 and that extend inwardly from one of the second baffles 60 to similarly terminate at a free end at which an ejection peg is disposed.

The first, second, and third baffles 52, 60, and 68 not only resist the entry of precipitation, insects, foreign matter, and the like, and permit the drainage of moisture therepast, but also function as structural members that support the panel 20 above the roof 12 and that resist deformation of the panel 20 in the event that a load is placed on the panel 20, such as by a worker walking on the ridge vent 4, and other such loads. The first and second stiffening ribs 88 and 100 similarly provide such structural support to the panel 20 and additional provide transverse stiffening to the panel 20 whereby in flexing the ridge vent 4 between the relaxed and installed positions, the portions of the panel 20 that actually flex during such movement are substantially limited to those portions of the panel 20 that lay between the free ends 92 of the first stiffening ribs 88. The first and second stiffening ribs 88 and 100 furthermore resist the entry of precipitation in the event that a wind should seek to blow precipitation past the first and second baffles 52 and 60 at an angle with respect to the first or second sides 32 and 36 and directly through aligned drainage spaces 66.

Further in this regard, the overlapping concave design of the first, second, and third baffles 52, 60, and 68 also interrupts such a wind or forced air stream into the ridge vent 4, which may carry moisture or water, and forms a return or creates a vortex to resist further penetration of the forced air stream into the ridge vent 4. Such a concave configuration thus slows the passage of unwanted air and water into the ridge vent 4.

Figure 1:
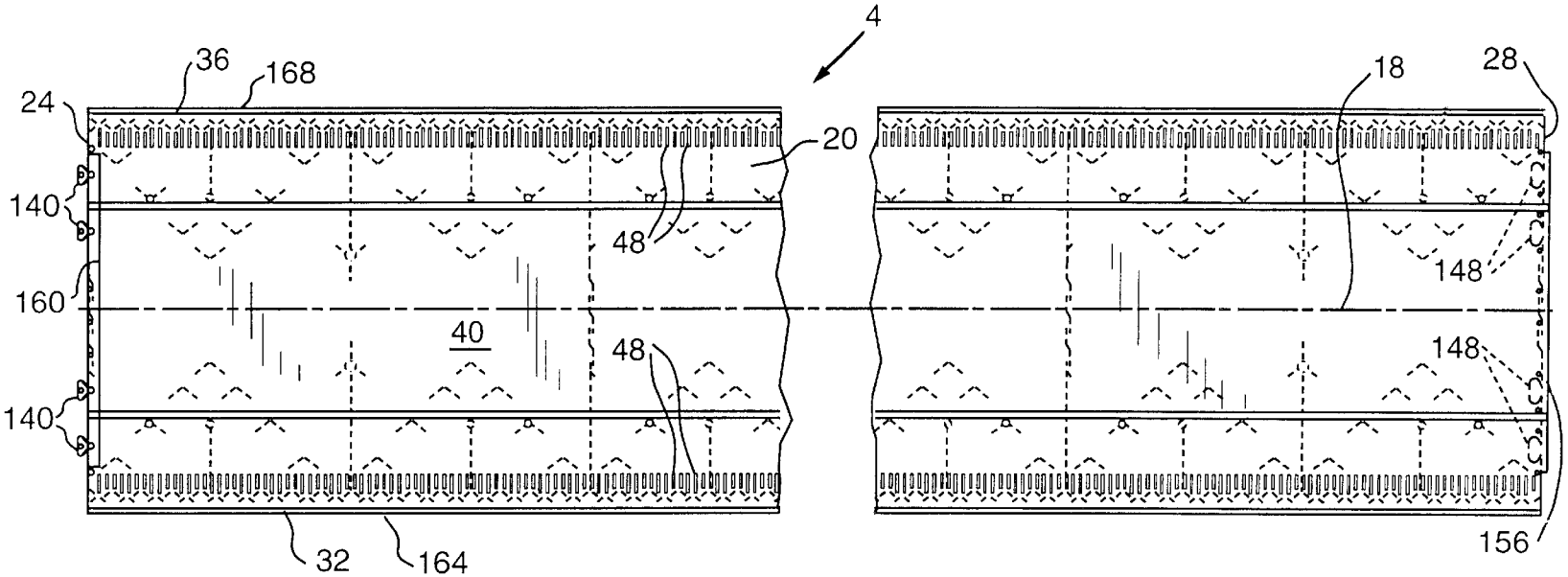
FIG. 1 is a top plan view of a ridge vent in accordance with the present invention.
Figure 2:
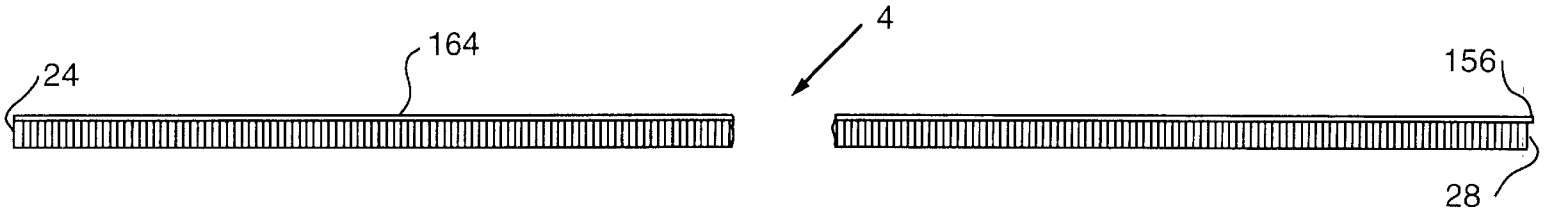
FIG. 2 is a side elevational view of the ridge vent.
Figure 3:
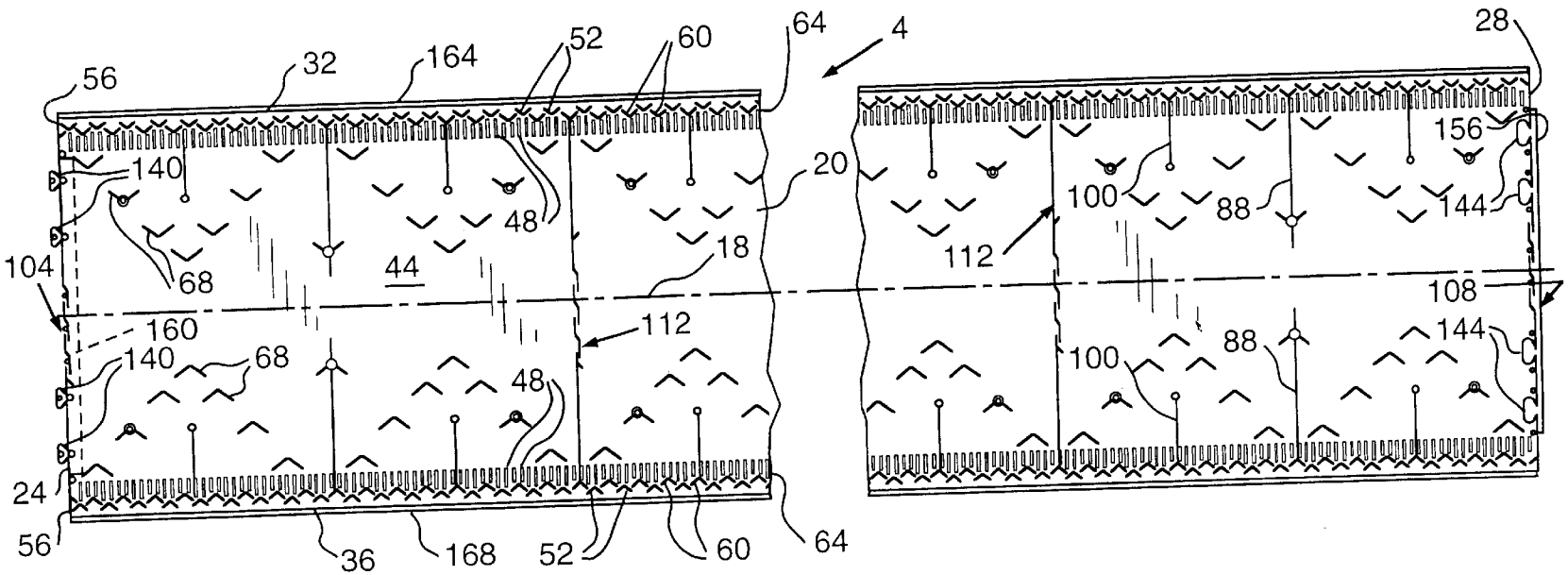
FIG. 3 is a bottom plan view of the ridge vent.

As is best shown in FIGS. 1 and 3, the ridge vent 4 additionally includes a first seal member 104 depending from the lower surface 44 that is disposed at the first end 24, and further includes a second seal member 108 depending from the lower surface 44 that is disposed at the second end 28. Furthermore, the ridge vent 4 includes one or more intermediate seal members 112 that are spaced at regularly spaced positions along the length of the ridge vent 4 between the first and second seal members 104 and 108. The first and second seal members 104 and 108 seal the first and second ends 24 and 28 of the ridge vent 4 and resist the entry of precipitation, insects, foreign matter, and the like into the ridge vent 4. The intermediate seal members 112 resist the flow of air and thus moisture in a longitudinal direction along the ridge vent 4 between the first and second seal members 104 and 108.

The intermediate seal members 112 can each additionally serve as an end seal taking the place the first and/or second seal members 104 and 108 in circumstances where the ridge vent 4 must be cut short, such as when the ridge vent 4 itself is of a greater length than that of the opening 8. In such a circumstance, a portion of the ridge vent 4 is cut away, thus removing either the first or the second seal member 104 or 108 from the rest of the ridge vent 4. The intermediate seal members 112 are thus provided to take the place of the removed first or second seal member 104 or 108 and to seal the corresponding end of the ridge vent 4 and resist entry of precipitation, insects, foreign matter, and the like therein. The intermediate seal members 112 are preferably regularly spaced from one another and from the first and second seal members 104 and 108, and in the embodiment shown are spaced approximately one foot away from on another. Other spacings are possible without departing from the concept of the present invention. The upper surface 40 of the panel 20 preferably is marked with transverse cut lines that are longitudinally spaced from the intermediate seal members 112 and that provide a mark or guide for trimming the ridge vent 4 near the appropriate intermediate seal member 112.

Figure 7:
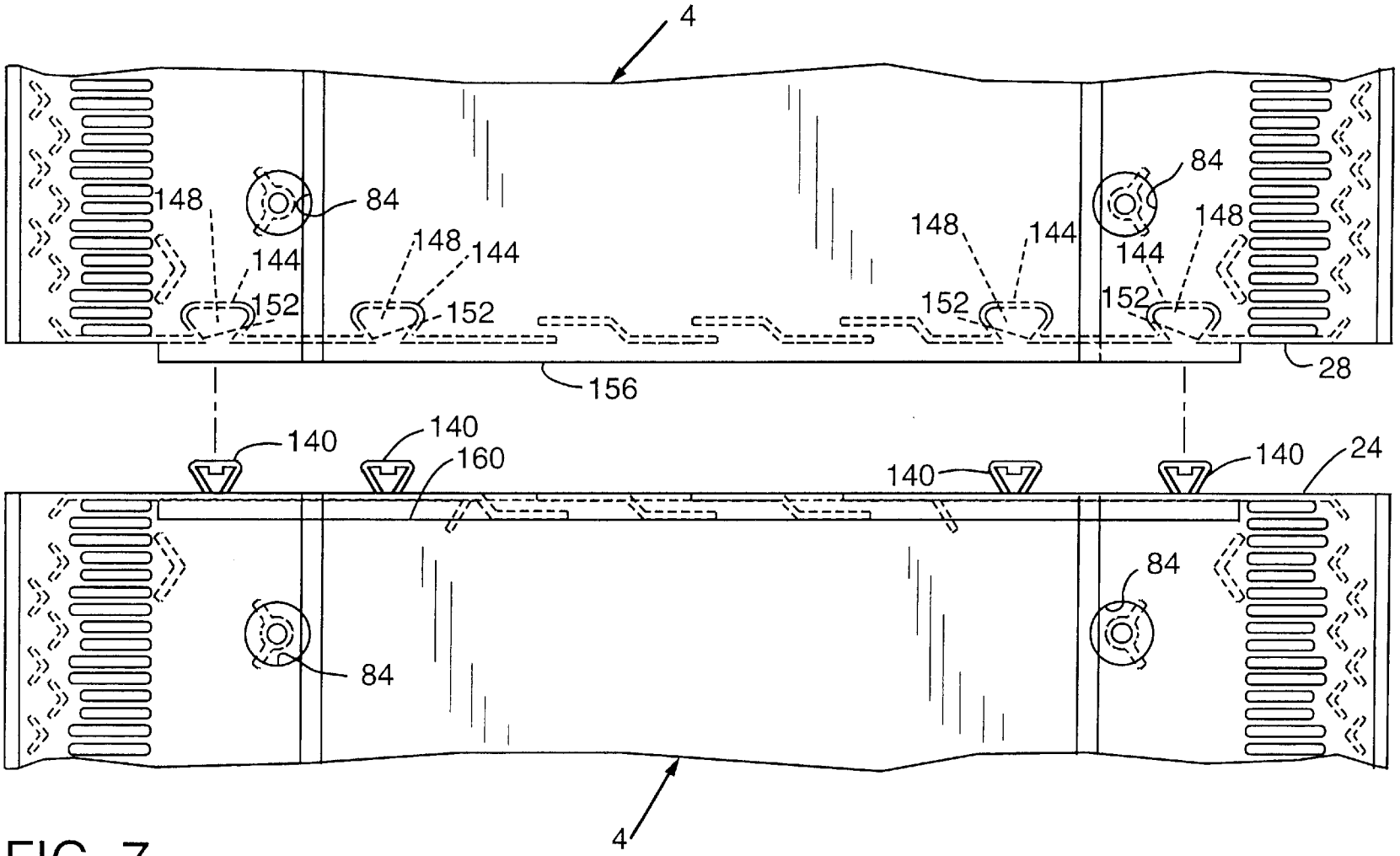
FIG. 7 is a top plan view of the first end of the ridge vent and of a second end of a similar second ridge vent.

The first seal member 104 includes an end seal plate 116 extending inwardly from each of the first and second sides 32 and 36 less than filly the distance to the longitudinal axis 18 and terminating at a free end. The first seal member 104 additional includes a pair of transitional seal plates 120 positioned adjacent one another and disposed between the end seal plates 116. As is best shown in FIG. 7, both transitional seal plates 120 and one of the end seal plates 116 employ offset portions to provide structures that at least partially overlap one another when the ridge vent 4 is in the relaxed position, and overlap one another to a greater extent when the ridge vent 4 is flexed to the installed position. Since the end and transitional seal plates 116 and 120 at least partially overlap one another with the ridge vent 4 in the relaxed position, it can be seen that the first seal member 104 provides no gap or space through which precipitation, insects, foreign matter, or the like can travel directly longitudinally into the ridge vent 4. Such thorough overlapping thus provides an improved sealing effect to the ridge vent 4.

The second member 108 is similarly formed with a pair end seal plates 124 extending from the first and second sides 32 and 36 of the ridge vent 4, and a pair of transitional seal plates 128 that are adjacent to one another and interposed between the end seal plates 124. Still similarly, each of the intermediate seal members 112 is formed with a pair of end seal plates 132 and a pair of transitional seal plates 136. Again, the second seal member 108 and intermediate seal members 112 similarly employ the offset portions that at least partially overlap one another when the ridge vent 4 is in the relaxed position and further overlap in the installed position to provide an improved seal for the ends of the ridge vent 4.

Figure 4:
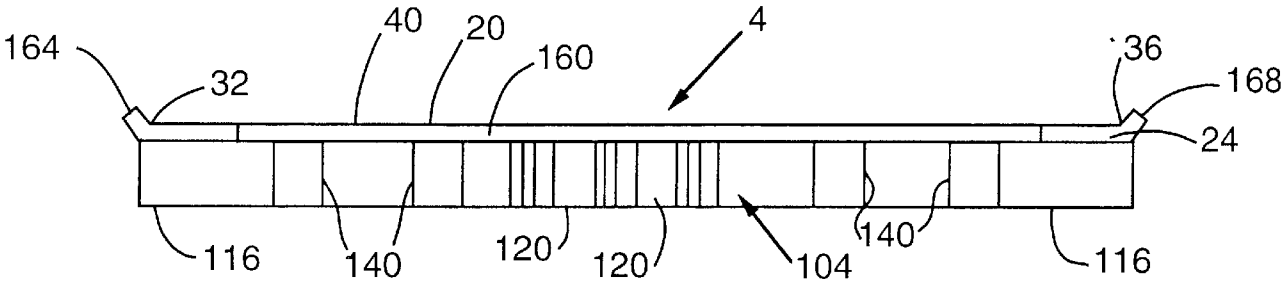
FIG. 4 is an end elevational view of a first end of the ridge vent.
Figure 5:
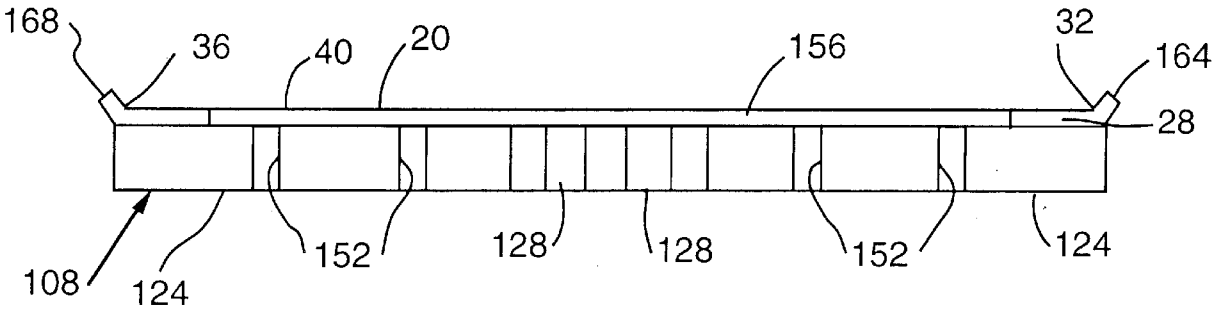
FIG. 5 is an end elevational view of a second opposite end of the ridge vent.

As can best be seen in FIGS. 4, 6, and 7, each of the end seal plates 116 of the first seal member 104 include a pair of dowels 140 disposed thereon. In the circumstance where the ridge vent 4 is formed by injection bolding and thus is a monolithic one-piece member, the dowels 140 can be said to be formed in each of the end seal plates 116. The dowels 140 are generally triangular in cross-section and extend in a direction substantially perpendicular to the plane of the panel 20 as depicted in FIGS. 5 and 7. It can further be seen that the dowels 140 are each substantially hollow and include an ejection peg formed therein.

As can best be seen in FIGS. 5 and 7, each end seal plate 124 of the second seal member 108 has a pair of lugs 144 formed therein, with each of the lugs 144 being formed with a generally triangular socket 148 having a constricted throat 152. As can be understood from FIGS. 7 and 8, the sockets 148 are configured to securely receive therein the dowels 140 of a similar second ridge vent 4 to permit secure inter-engagement between the adjacent ridge vents 4. The constricted throat 152 of each socket 148 and the generally triangular configuration of both the sockets 148 and the dowels 140 operate as mortise and tenon joints that provide secure inter-engagement therebetween and between adjacent ridge vents 4. Such generally triangular dowels 140 and sockets 148 further facilitate alignment due to the opposing angular surfaces of the male/female arrangement thereof, which facilitates assembly either at the factory or at the job site when the ridge vent members 4 are joined with one another. It thus can be seen that such a simple yet secure inter-engagement system permits the single molded ridge vent 4 to be offered in individual molded pieces that provide other packaging or installation possibilities.

As can further be seen in FIG. 7, a flap 156 protrudes longitudinally outwardly from the second end 28 and extends substantially along the width of the panel 20 between the apertures 48. Similarly, a recess 160 is formed into the panel 20 adjacent the first end 24 and extends between the apertures 48. As can be understood from FIG. 7, the flap 156 is configured to-be overlapping received in the recess 160 of a similar adjacent ridge vent 4. As can be understood from FIG. 8, the flap 156 thus provides an overlapping seal that resists the entry of precipitation, foreign matter, insects, and the like vertically downward from the upper surface 40 of the panel 20 and past the ridge vent 4 into the roof 12. It can further be seen that the flap 156 does not extend above or otherwise interfere with the apertures 48.

Figure 8:
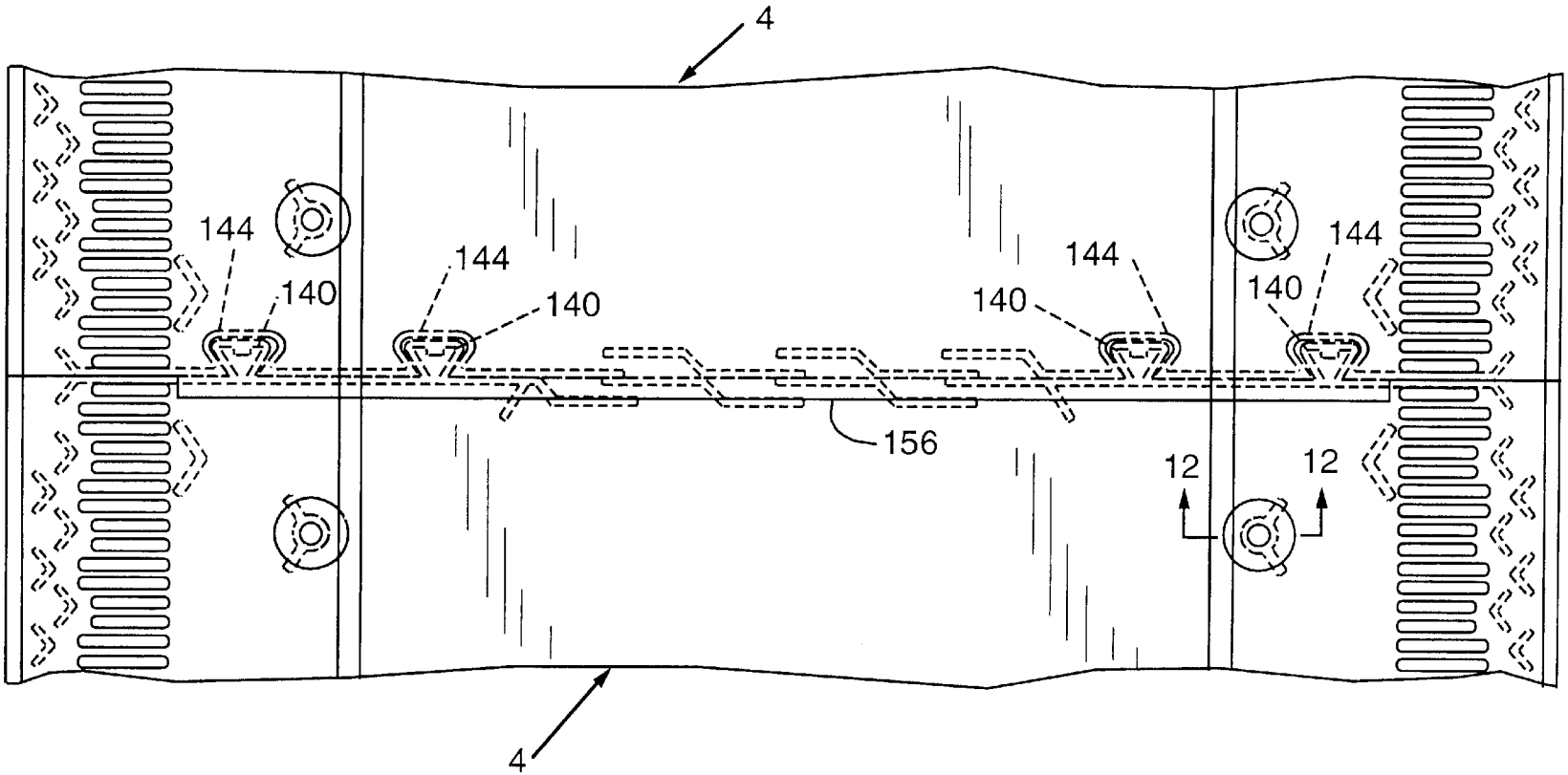
FIG. 8 is a view similar to FIG. 7, except showing the first and second ridge vents securely inter-engaged with one another.

It thus can be seen that in joining a pair of ridge vents 4 in an end-to-end relation such as is depicted generally in FIGS. 7 and 8, the second end 28 is raised vertically above the first end 24 and the sockets 148 of the second end 28 are aligned with the dowels 140 of the first end 24. The first and second ends 24 and 28 of the adjacent ridge vents 4 are then translated with respect to one another in a direction substantially perpendicular to the upper surfaces 40 in the vicinity of the dowels 140 and sockets 148 to cause the dowels 140 to become securely engaged in the sockets 148 and to cause the flap 156 to be overlappingly received in the recess 160. In this regard, while the ridge vent 4 is flexible about the longitudinal axis 218 between the relaxed and installed positions and thus the upper surface 40 is not always in a planar condition, it is understood that the aforementioned movement of the dowels 140 with respect to the sockets 148 occurs perpendicular to the regions of the upper surface 40 that are in the vicinity of the dowels 140 and sockets 148 which are at least regionally of a generally planar condition. Such attachment provides secure inter-engagement between the two ridge vents 4 and resists the entry of precipitation, insects, foreign matter, or the like vertically downward through the juncture between the two ridge vents 4.

As can further be seen from FIGS. 4 and 5, the ridge vent 4 additionally includes a first lip 164 that protrudes angularly outwardly from the first side 32 and a second lip 168 that protrudes angularly outwardly from the second side 36. The first and second lips 164 and 168 are oriented at an angle in the range of about 30° to 60° from the upper surface 40 adjacent the first and second lips 164 and 168.

Figure 11:
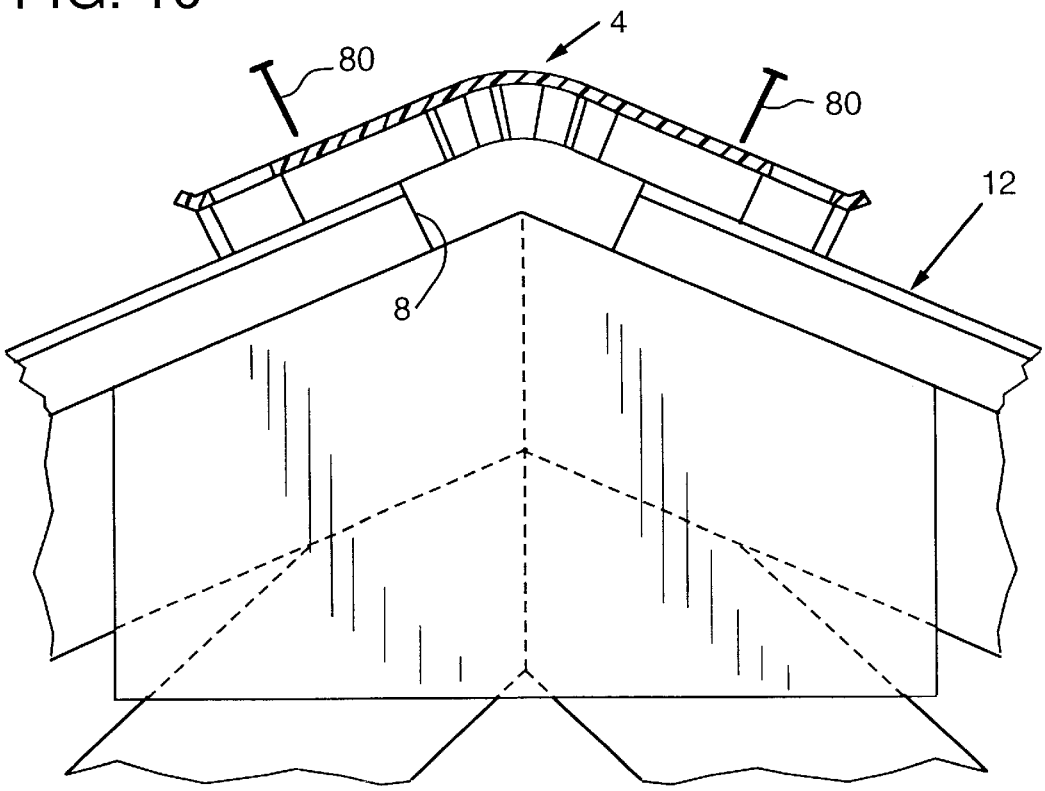
FIG. 11 is a view similar to FIG. 10, except showing the ridge vent in an installed position on the roof and prior to receiving fasteners therein.

As can be understood from FIGS. 4, 5, and 11, the first and second lips 164 and 168 advantageously operate as air deflectors for wind that is traveling upwardly along the roof and that encounters the first or second sides 32 or 36 of the ridge vent 4. More specifically, as wind travels upward along the roof 12 and encounters either of the first and second lips 164 and 168, the wind is deflected above the upper surface 40 of the panel 20 such that a vortex is formed above the apertures 48 adjacent the first or second lip 164 or 168 that deflected the wind. Such a vortex creates a low-pressure region that promotes ventilation from within the attic below the roof and out of the apertures 48. The first and second lips 164 and 168 preferably have a width in the range of about ⅛–¼ inch and preferably are approximately 3⁄16 inch in width.

In use, the ridge vent 4 advantageously is initially resiliently deformed into the roll 16 prior to installation on the roof 12. The ridge vent 4 is then at least partially unrolled (as is shown in FIG. 9) and is positioned over the opening 8 formed in the roof 12. When the proper alignment is achieved, the ridge vent 4 is resiliently deformed from the relaxed position to the installed position whereby the ridge vent 4 conforms to the shape of the roof 12. Fasteners 8 are then received into the ridge vent 4 through the fastener-receiving holes 76 of the fastener bosses 72. In this regard, while the fasteners 8 may be nails or staples, it is understood that the fasteners 8 likewise may be a screws, rivets or other such fasteners. It is further understood that in other embodiments, the ridge vent 4 may be mounted on the roof with the use of adhesives or other types of fastening systems.

The roll 16 of the ridge vent 4 is continually unrolled along the opening 8 formed in the roof, with additional fasteners 8 being received in the fastener-receiving holes 76 to attach the additionally unrolled portions of the ridge vent 4 onto the roof 12.

Depending upon the length of the ridge vent 4 and the length of the opening 8, one of three possibilities typically will exist regarding the terminal end of the ridge vent 4 after the ridge vent 4 has been completely unrolled. The first possibility is that the terminal end of the ridge vent 4 will correspond with the end of the opening 8, in which circumstance the terminal end of the ridge vent 4 is fastened to the roof 12 with additional fasteners 80. The second possibility is that the ridge vent 4 will be longer than the opening 8 such that the terminal end of the ridge vent 4 extends a substantial distance beyond the opening 8. In such a circumstance, the ridge vent 4 is cut along a transverse mark corresponding with one of the intermediate seal members 12 in order to remove the unneeded portion of the ridge vent 4 and to cause the intermediate seal member 112 adjacent the cut end of the ridge vent 4 to operate as an end seal member. The remaining portion of the ridge vent 4 from which the excess has been cut is then fastened to the roof 12 with fasteners 80.

The third possibility exists when the ridge vent 4 is shorter than the opening 8 such that an additional ridge vent 4 must be joined with the terminal end of the existing ridge vent 4 and securely inter-connected therewith prior to mounting the second ridge vent 4 on the roof 12. More specifically, the sockets 148 of one of the ridge vents 4 are aligned with the dowels 140 of the other ridge vent 4, and the ends of ridge vents 4 are then translated with respect to one another in a direction substantially perpendicular to the upper surface 40 in the vicinity of the dowels 140 and the sockets 148.

In translating the adjacent ends of the ridge vents 4 with respect to one another in the aforementioned fashion, the dowels 140 of one of the ridge vents 4 are received in the sockets 148 of the other ridge vent 4. Simultaneously therewith, the recess 160 formed in the second end 128 of one of the panels 20 overlappingly receives therein the flap 156 that extends outwardly from the first end 24 of the other ridge vent 4. The adjacent ridge vents 4 are thus securely inter-engaged with one another, and the overlapping engagement of the flap 156 in the recess 160 resists the entry of precipitation, insects, foreign matter, and the like vertically downward between the ridge vents 4 and into the attic below the roof 12.

After the second ridge vent 4 has been securely inter-engaged with the first ridge vent 4 in the aforementioned fashion, the worker continues to unroll the second ridge vent 4 and to fasten the second ridge vent 4 to the roof 12 with additional fasteners 80. Again, the terminal end of the second ridge vent 4 may correspond precisely with the end of the opening 8, may need to be cut away due to excess length, or may need to be joined with a third ridge vent 4 in the aforementioned fashion, and so forth. Once the ridge vent 4 is fastened in place atop the roof 12, shingles may be fastened to the upper surface 40 between the rows of apertures 48 in order to minimize the appearance of the ridge vent 4 and to cause the ridge vent 4 to better blend with the roof 12.

In use, it can be seen that with the ridge vent 4 installed on the roof 12, the apertures 48 serve as drainage holes that permit precipitation to flow downwardly therethrough and onto the upper surface of the roof 12, after which the precipitation flows down the roof and through the drainage spaces 66 between the first and second baffles 52 and 60. It can be seen that the apertures 48 are of two different lengths. The apertures that terminate adjacent the second baffles 60 are of a first length, and the apertures 48 that terminate at the first baffles 52 are of a second slightly longer length. It can be seen that the ends of the apertures 48 opposite the first and second baffles 52 and 60 are aligned with one another. The aforementioned configuration is intended to maximize the ventilation area provided by the apertures 48 while still retaining a line with which the cap shingles can be aligned prior to being mounted onto the upper surface 40.

The apertures 48 additionally permit air within the attic below the roof 12 to circulate through the opening 8, through the ridge vent 4, and out of the apertures 48. In this regard, it is understood that additional air inlet openings may be provided at the lower ends of the roof, such as in the eves. As is understood in the relevant art, the air within the attic, whether during the summer or the winter, is typically at a higher temperature than the air surrounding and external to the roof 12. As such, the air within the attic will tend to rise and flow upward through the opening 8 and out of the apertures 48. Simultaneously therewith, additional air will flow into the air inlet openings of the roof 12 to take the place of the air that is flowing out of the opening 8. It can be seen that the third baffles 68 are advantageously arranged and spaced sufficiently from one another so as not to obstruct the natural ventilation of air within the attic through the ridge vent 4 and out of the apertures 48.

As indicated hereinbefore, such ventilation can be increased by wind that blows upward along the roof 12 and that is deflected by the first or second lips 164 or 168. In such fashion, an area of relatively lower pressure or a vacuum is formed immediately above the apertures 48, whereby the air within the attic is not only convectively removed through the apertures 48 but is also pulled out by the vacuum that is created by the first and second lips 164 and 168.

Such ventilation through the apertures 48 additionally promotes the removal of moisture-laden air from within the attic. As indicated hereinbefore, such moisture-laden air results from daily activities within the structure below the roof 12. The ridge vent 4 advantageously permits such moisture-laden air to be vented from the attic, and if any moisture from the moisture-laden air condenses on the lower surface 44 of the panel 20, such moisture droplets will tend to roll downward along the lower surface 44 to the first and second sides 32 and 36 and can be drained through the drainage spaces 66.

The overlapping configuration of the first and second baffles 52 and 60 resists the entry of precipitation and foreign matter that may be driven by wind, as well as the entry of crawling and flying insects, yet permits moisture-laden air from within the attic below the roof 12 as well as moisture that has flowed downward through the apertures 48 to be drained through the drainage spaces 66. The first and second baffles 52 and 60 advantageously are relatively small structures that are spaced from one another along the first and second sides 32 and 36 of the ridge vent 4, and thus do not meaningfully interfere with the resilient deformation or rolling of the ridge vent 4 into the roll 16. Indeed, as can be seen from the accompanying figures, the structures that depend from the lower surface 44 of the panel 20 extend at most only a short longitudinal distance along the length of the ridge vent 4, such that they do not interfere with lengthwise resilient deformation of the ridge vent 4. In contrast, if the first and second baffles 52 and 60 were each relatively larger and fewer in number than depicted in the accompanying figures, and thus each extended a relatively longer distance along the length of the ridge vent 4, such larger baffles would provide an undesirable greater resistance to rolling the ridge vent 4 into the roll 16. The ridge vent 4 is thus advantageously configured with large numbers of relatively small and spaced first and second baffles 52 and 60 that facilitate the ridge vent 4 being resiliently deformed or rolled to form the roll 16, which advantageously saves time and effort in installing the ridge vent 4 on the roof 12.

The first, second, and third baffles 52, 60, and 68, as well as the first and second stiffening ribs 88 and 100, and the first, second, and intermediate seal members 104, 108, and 112 retain the panel 20 away from the roof 12 and resist the ridge vent 4 from being crushed in the event that a worker or other person steps on the installed ridge vent 4 or in the event that tree branches for other matter fall onto the ridge vent 4. The ridge vent 4 is approximately 1 inch in height, although the ridge vent 4 may be configured to have heights greater or lesser than this without departing from the concept of the present invention. The seal plates of each of the first, second, and intermediate seal members 104, 108, and 112 at least partially overlap one another at all positions of the ridge vent 4 between the relaxed and installed positions in order to provide a highly effective seal that resist entry of precipitation, insects, foreign matter, and the like through the ends of the installed ridge vent 4.

The dowels 140 and corresponding sockets 148 with their constricted throats 152 operate as dovetail or mortis and tenon joints to securely inter-engage adjacent ridge vents 4 with one another. The overlapping reception of the flap 156 of one ridge vent 4 in the recess 160 of an adjacent ridge vent 4 overlappingly resists the entry of precipitation, foreign matter, insects, and the like vertically downward between the adjacent ridge vents 4 and into the attic below the roof 12.

EXAMPLE 1

As a first example of the ridge vent system of the present invention, a pair of ridge vents 4 are securely inter-engaged with one another over an opening 8 in a roof 12 by receiving the dowels 140 of the first ridge vent member in the sockets 148 of the second ridge vent member. The ridge vent members 4 are then fastened to the roof 12 with a plurality of fasteners 80 which, in the present example, are nails with flared heads. A plurality of cap shingles are then fastened to the upper surfaces 40 of the panels 20 of the ridge vents 4 with more nails, although other fasteners and fastening methodologies may be employed for such purpose.

Each ridge vent is approximately twenty feet in length, and is 14½ inches wide in the relaxed position inclusive of the first and second lips 164 and 168. The first and second lips 164 and 168 are each approximately 3/16 inch wide and extend outwardly from the panels 20 at an angle of approximately 45° from the upper surfaces 40. The ridge vents 4 are approximately one inch in height exclusive of the first and second lips 164 and 168, and the apertures are of lengths approximately 11/16 inch and 7/8 inch. The first baffles 52 are each approximately 7/16 inch in length and are spaced approximately 3/8 inch apart. The second baffles 60 are similarly sized and spaced from one another. The ridge vents 4 manufactured of a polypropylene copolymer and are generally black in color.

While particular embodiments of the present invention have been described herein, it is understood that various changes, additions, modifications, and adaptations may be made without departing from the scope of the present invention as set forth in the following claims.

What is claimed is:

1. A ridge vent structured to be mounted over an opening formed in a roof, the ridge vent comprising:

an elongated panel having a first end and a second end and having a pair of opposed sides;

panel having an upper surface and a lower surface, the lower surface being structured to face toward the roof;

a plurality of first baffles depending from the lower surface of the panel, the first baffles being spaced from one another and arranged to form a pair of first rows adjacent the sides of the panel;

a plurality of second baffles depending from the lower surface of the panel, the second baffles being spaced from one another and arranged to form a pair of second rows disposed adjacent the first rows, the second baffles alternating with and at least partially overlapping the first baffles along each side of the panel, the first and second baffles being spaced from one another to provide a plurality of drainage spaces between the first and second baffles, the second rows being disposed between the first rows;

the first and second baffles each having an outwardly facing generally concave configuration;

a plurality of third baffles depending from the lower surface of the panel, the third baffles being disposed between the pair of second rows; and the panel being formed with a plurality of apertures, a portion of the apertures being disposed generally between one row of the pair of second rows and a portion of the third baffles, another portion of the apertures being disposed generally between the other row of the pair of second rows and another of the third baffles.

2. The ridge vent of claim 1, wherein the apertures are elongated and each terminate at one of the first and second rows, the apertures that terminate at the first rows being of a first length, and the apertures that terminate at the second rows being of a second length.

3. A ridge vent structured to be mounted over an opening formed in a roof, the ridge vent comprising:

an elongated panel having a first end and a second end and having a pair of opposed sides;

the panel having an upper surface and a lower surface, the lower surface being structured to face toward the roof;

a plurality of first baffles depending from the lower surface of the panel, the first baffles being spaced from one another and arranged to form a pair of first rows adjacent the sides of the panel;

a plurality of second baffles depending from the lower surface of the panel, the second baffles being spaced from one another and arranged to form a pair of second rows disposed adjacent the first rows, the second baffles alternating with and at least partially overlapping the first baffles along each side of the panel, the first and second baffles being spaced from one another to provide a plurality of drainage spaces between the first and second baffles, the second rows being disposed between the first rows;

the first and second baffles each having an outwardly facing generally concave configuration;

a plurality of third baffles depending from the lower surface of the panel, the third baffles being disposed between the pair of second rows;

the panel being formed with a plurality of apertures adjacent the second baffles; and a pair of lips extending outwardly from the sides of the panels and being oriented at an angle of about 10° to 60° with respect to the upper surface.

4. The ridge vent of claim 3, wherein the lips are disposed outwardly of the first baffles.

5. The ridge vent of claim 3, wherein the lips have a width of about one-eighth to one-quarter of an inch.

6. The ridge vent of claim 1, wherein the third baffles each have an outwardly facing generally concave configuration.

7. The ridge vent of claim 1, wherein the third baffles are arranged in a generally sinusoidal pattern on the panel.

8. The ridge vent of claim 1, further comprising a generally triangular first dowel disposed at the first end and a first lug having a generally triangular first socket with a constricted throat disposed at the second end, the first dowel being structured to be receivable in a second socket of a second lug of a similar second ridge vent to provide secure inter-engagement with the second ridge vent.

9. The ridge vent of claim 8, wherein the first socket is structured to receive therein a third dowel of a similar third ridge vent to provide secure inter-engagement with the third ridge vent.

10. A ridge vent structured to be mounted over an opening formed in a roof, the ridge vent comprising:

an elongated panel having a first end and a second end and having a pair of opposed sides;

the panel having an upper surface and a lower surface, the lower surface being structured to face toward the roof;

a plurality of first baffles depending from the lower surface of the panel, the first baffles being spaced from one another and arranged to form a pair of first rows adjacent the sides of the panel;

a plurality of second baffles depending from the lower surface of the panel, the second baffles being spaced from one another and arranged to form a pair of second rows disposed adjacent the first rows, the second baffles alternating with and at least partially overlapping the first baffles along each side of the panel, the first and second baffles being spaced from one another to provide a plurality of drainage spaces between the first and second baffles, the second rows being disposed between the first rows;

the first and second baffles each having an outwardly facing generally concave configuration;

a plurality of third baffles depending from the lower surface of the panel, the third baffles being disposed between the pair of second rows;

a generally triangular first dowel disposed at the first end and a first lug having a generally triangular first socket with a constricted throat disposed at the second end, the first dowel being structured to be receivable in a second socket of a second lug of a similar second ridge vent to provide secure inter-engagement with the second ridge vent; and a flap extending outwardly from the first end, and wherein the panel is formed with a recess adjacent the second end, the flap being structured to be overlappingly receivable in a second recess of a similar second ridge vent.

11. The ridge vent of claim 10, wherein the recess is structured to overlappingly receive a third flap of a similar third ridge vent.

12. A ridge vent structured to be mounted over an opening formed in a roof, the ridge vent comprising:

an elongated panel having a first end and a second end and having a pair of opposed sides;

the panel having an upper surface and a lower surface, the lower surface being structured to face toward the roof;

a plurality of first baffles depending from the lower surface of the panel, the first baffles being spaced from one another and arranged to form a pair of first rows adjacent the sides of the panel;

a plurality of second baffles depending from the lower surface of the panel, the second baffles being spaced from one another and arranged to form a pair of second rows disposed adjacent the first rows, the second baffles alternating with and at least partially overlapping the first baffles along each side of the panel, the first and second baffles being spaced from one another to provide a plurality of drainage spaces between the first and second baffles, the second rows being disposed between the first rows;

the first and second baffles each having an outwardly facing generally concave configuration;

a plurality of third baffles depending from the lower surface of the panel, the third baffles being disposed between the pair of second rows;

a general triangular first dowel disposed at the first end and a first lug having a generally triangular first socket with a constricted throat disposed at the second end, the first dowel being structured to be receivable in a second socket of a second lug of a similar second ridge vent to provide secure inter-engagement with the second ridge vent;

wherein the panel is resiliently deformable about a longitudinal axis between a relaxed position and an installed position, the panel in the installed position being structured to conform generally to the shape of the roof; and a pair of seal members depending from the lower surface of the panel at the ends of the panel, each seal member including at least a pair of seal plates that a least partially overlap one another when the panel is in the relaxed position, the first dowel being formed in one of the seal members, the first lug being formed in the other of the seal members.

13. The ridge vent of claim 1, wherein the ridge vent is structured to be resiliently deformable lengthwise to form a roll.

14. The ridge vent of claim 1, wherein the first and second baffles are generally V-shaped.

15. The ridge vent of claim 1, wherein the third baffles are generally V-shaped.

16. The ridge vent of claim 1, further comprising a stiffening member depending from the lower surface of the panel and extending laterally from one of a first baffle and a second baffle.

17. The ridge vent of claim 16, wherein the stiffening member terminates at a free end opposite the one of a first baffle and a second baffle and inward of the apertures.

18. The ridge vent of claim 1, wherein the ridge vent is composed of a resilient resinous material.

19. The ridge vent of claim 18, wherein the ridge vent is formed substantially of a material from the group consisting of polypropylene copolymer and low density polyethylene.

20. The ridge vent of claim 19, wherein the material out of which the ridge vent is formed additionally includes a butadiene modifier.

21. A ridge vent structured to be mounted over an opening formed in a roof, the ridge vent comprising:

an elongated panel having a first end and a second end and a pair of opposed sides;

the panel having an upper surface and a lower surface, the lower surface being structured to face toward the roof;

a plurality of first baffles depending from the lower surface of the panel, the first baffles being spaced from one another and arranged to form a pair of first rows adjacent the sides of the panel;

a plurality of second baffles depending from the lower surface of the panel, the second baffles being spaced from one another and arranged to form a pair of second rows disposed adjacent the first rows, the second baffles alternating with and at least partially overlapping the first baffles along each side of the panel, the first and second baffles being spaced from one another to provide a plurality of drainage spaces between the first and second baffles, the second rows being disposed between the first rows;

the first and second baffles each having an outwardly facing generally concave configuration;

a plurality of third baffles depending from the lower surface of the panel, the third baffles being disposed between the pair of second rows; and wherein at least some of the third baffles have a generally cylindrical fastener-receiving hole.

22. The ridge vent of claim 21, wherein the upper surface includes a depression for receiving a head of a fastener.

23. A ridge vent structured to be mounted over an opening formed in a roof, the ridge vent comprising:

an elongated panel having a first end and a second end and a pair of opposed sides;

the panel having an upper surface and a lower surface, the lower surface being structured to face toward the roof;

a plurality of first baffles depending from the lower surface of the panel, the first baffles being spaced from one another and arranged to form a pair of first rows adjacent the sides of the panel;

a plurality of second baffles depending from the lower surface of the panel, the second baffles being spaced from one another and arranged to form a pair of second rows disposed adjacent the first rows, the second baffles alternating with and at least partially overlapping the first baffles along each side of the panel, the first and second baffles being spaced from one another to provide a plurality of drainage spaces between the first and second baffles, the second rows being disposed between the first rows;

the first end including a first lug having a first socket with a constricted throat;

the second end including a first dowel; and the first dowel being structured to be receivable in a second socket of a second lug of a similar second ridge vent to provide secure inter-engagement with the second ridge vent;

a plurality of third baffles depending from the lower surface of the panel, the third baffles being disposed between the pair of second rows; and the panel being formed with a plurality of apertures, a portion of the apertures being disposed generally between one row of the pair of second rows and a portion of the third baffles, another portion of the apertures being disposed generally between the other row of the pair of second rows and another portion of the third baffles.

24. The ridge vent of claim 23, wherein the first dowel is generally triangular and the first socket is correspondingly generally triangular.

25. The ridge vent of claim 23, wherein the first socket is structured to receive therein a third dowel of a similar third ridge vent to provide secure inter-engagement with the third ridge vent.

26. The ridge vent of claim 23, wherein the first and second baffles each have an outwardly facing generally concave configuration.

27. The ridge vent of claim 23, wherein the third baffles each have an outwardly facing generally concave configuration.

28. The ridge vent of claim 23, wherein the third baffles are arranged in a generally sinusoidal pattern on the panel.

29. A ridge vent structured to be mounted over an opening formed in a roof, the ridge vent comprising:

an elongated panel having a first end and a second end and a pair of opposed sides;

the panel having an upper surface and a lower surface, the lower surface being structured to face toward the roof;

a plurality of first baffles depending from the lower surface of the panel, the first baffles being spaced from one another and arranged to form a pair of first rows adjacent the sides of the panel;

a plurality of second baffles depending from the lower surface of the panel, the second baffles being spaced from one another and arranged to form a pair of second rows disposed adjacent the first rows, the second baffles alternating with and at least partially overlapping the first baffles along each side of the panel, the first and second baffles being spaced from one another to provide a plurality of drainage spaces between the first and second baffles, the second rows being disposed between the first rows;

the first end including a first lug having a first socket with a constricted throat;

the second end including a first dowel;

the first dowel being structured to be receivable in a second socket of a second lug of a similar second ridge vent to provide secure inter-engagement with the second ridge vent;

the panel being formed with a plurality of apertures adjacent the second baffles; and a pair of lips extending outwardly from the sides of the panels and being oriented at an angle of about 10° to 60° with respect to the upper surface.

30. A ridge vent structured to be mounted over an opening formed in a roof, the ridge vent comprising:

an elongated panel having a first end and a second end and a pair of opposed sides;

the panel having an upper surface and a lower surface, the lower surface being structured to face toward the roof;

a plurality of first baffles depending from the lower surface of the panel, the first baffles being spaced from one another and arranged to form a pair of first rows adjacent the sides of the panel;

a plurality of second baffles depending from the lower surface of the panel, the second baffles being spaced from one another and arranged to form a pair of second rows disposed adjacent the first rows, the second baffles alternating with and at least partially overlapping the first baffles along each side of the panel, the first and second baffles being spaced from one another to provide a plurality of drainage spaces between the first and second baffles, the second rows being disposed between the first rows;

the first end including a first lug having a first socket with a constricted throat;

the second end including a first dowel;

the first dowel being structured to be receivable in a second socket of a second lug of a similar second ridge vent to provide secure inter-engagement with the second ridge vent; and a flap extending outwardly from the first end, and wherein the panel is formed with a recess adjacent the second end, the flap being structured to be overlappingly receivable in a second recess of a similar second ridge vent.

31. The ridge vent of claim 30, wherein the recess is structured to overlappingly receive a third flap of a similar third ridge vent.

32. A ridge vent structured to be mounted over an opening formed in a roof, the ridge vent comprising:

an elongated panel having a first end and a second end and a pair of opposed sides;

the panel having an upper surface and a lower surface, the lower surface being structured to face toward the roof;

a plurality of first baffles depending from the lower surface of the panel, the first baffles being spaced from one another and arranged to form a pair of first rows adjacent the sides of the panel;

a plurality of second baffles depending from the lower surface of the panel, the second baffles being spaced from one another and arranged to form a pair of second rows disposed adjacent the first rows, the second baffles alternating with and at least partially overlapping the first baffles along each side of the panel, the first and second baffles being spaced from one another to provide a plurality of drainage spaces between the first and second baffles, the second rows being disposed between the first rows;

the first end including a first lug having a first socket with a constricted throat;

the second end including a first dowel;

the first dowel being structured to be receivable in a second socket of a second lug of a similar second ridge vent to provide secure inter-engagement with the second ridge vent;

wherein the panel is resiliently deformable about a longitudinal axis between a relaxed position and an installed position, the panel in the installed position being structured to conform to the shape of the roof; and a pair of seal members depending from the lower surface of the panel at the ends of the panel, each seal member including at least a pair of seal plates that at least partially overlap one another when the panel is in the relaxed position, the first dowel being formed in one of the seal members, the first socket being formed in the other of the seal members.

33. The ridge vent of claim 23, wherein the ridge vent is structured to be lengthwise resiliently deformable to form a roll.

34. The ridge vent of claim 23, wherein the first and second baffles are generally V-shaped.

35. A ridge vent structured to be mounted over an opening formed in a roof, the ridge vent comprising:

an elongated panel having a first end and a second end and having a pair of opposed sides;

the panel including an upper surface and a lower surface, the lower surface being structured to face toward the roof;

the panel being resiliently deformable about a longitudinal axis between a relaxed position and an installed position, the panel in the installed position being structured to conform to the shape of the roof;

a plurality of first baffles depending from the lower surface of the panel, the first baffles being spaced from one another and arranged to form a pair of first rows adjacent the sides of the panel;

a plurality of second baffles depending from the lower surface of the panel, the second baffles being spaced from one another and arranged to form a pair of second rows disposed adjacent the first rows, the second baffles alternating with and at least partially overlapping the first baffles along each side of the panel, the first and second baffles being spaced from one another to provide a plurality of drainage spaces between the first and second baffles, the second rows being disposed between the first rows;

a pair of seal members depending from the lower surface of the panel at the opposed ends of the panel, each seal member including at least a pair of seal plates that at least partially overlap one another when the panel is in the relaxed position; and the ridge vent being structured to be lengthwise resiliently deformable to form a roll.

36. The ridge vent of claim 35, further comprising a generally triangular first dowel formed in the first end and a first lug having a generally triangular first socket with a constricted throat formed in the second end, the first dowel being structured to be receivable in a second socket of a second lug of a similar second ridge vent to provide secure inter-engagement with the second ridge vent.

37. The ridge vent of claim 36, wherein the first socket is structured to receive therein a third dowel of a similar third ridge vent to provide secure inter-engagement with the third ridge vent, the first dowel being formed in one of the seal members, the first lug being formed in the other of the seal members.

38. The ridge vent of claim 36, further comprising a flap extending outwardly from the first end, and wherein the panel is formed with a recess adjacent the second end, the flap being structured to be overlappingly receivable in a second recess of a similar second ridge vent, and the recess being structured to overlappingly receive a third flap of a similar third ridge vent.

39. The ridge vent of claim 35, wherein the first and second baffles each have an outwardly facing generally concave configuration.

40. The ridge vent of claim 35, further comprising a plurality of third baffles depending from the lower surface of the panel, the third baffles being disposed between the pair of second rows.

41. The ridge vent of claim 40, wherein the third baffles each have an outwardly facing generally concave configuration.

42. The ridge vent of claim 40, wherein the third baffles are arranged in a generally sinusoidal pattern on the panel.

43. The ridge vent of claim 35, wherein the panel is formed with a plurality of apertures adjacent the second baffles.

44. The ridge vent of claim 43, further comprising a pair of lips extending outwardly from the sides of the panels and being oriented at an angle of about 10° to 60° with respect to the upper surface.

45. The ridge vent of claim 35, wherein the first and second baffles are generally V-shaped.

46. A ridge vent system mounted over an opening formed in a peak of a roof, the ridge vent system comprising:

at least a first ridge vent member and a second ridge vent member connected with one another, the first and second ridge vent members each including:

an elongated panel having a first end and a second end and a pair of opposed sides;

the panel including an upper surface and a lower surface, the lower surface facing toward the roof;

a plurality of first baffles depending from the lower surface of the panel, the first baffles being spaced from one another and arranged to form a pair of first rows adjacent the sides of the panel;

a plurality of second baffles depending from the lower surface of the panel, the second baffles being spaced from one another and arranged to form a pair of second rows disposed adjacent the first rows, the second baffles alternating with and at least partially overlapping the first baffles along each side of the panel, the first and second baffles being spaced from one another to provide a plurality of drainage spaces between the first and second baffles, the second rows being disposed between the first rows;

a plurality of third baffles depending from the lower surface of the panel, the third baffles being disposed between the pair of second rows;

the panel being formed with a plurality of apertures, a portion of the apertures being disposed generally between one row of the pair of second rows and a portion of the third baffles, another portion of the apertures being disposed generally between the other row of the pair of second rows and another portion of the third baffles;

the first end including a first lug having a generally triangular socket with a constricted throat;

the second end including at least a first generally triangular dowel; and the first dowel of the first ridge vent member being received in the first socket of the second ridge vent member to securely inter-engage the first and second ridge vent members.

47. The ridge vent system of claim 46, wherein the first and second baffles each have an outwardly facing generally concave configuration.

48. The ridge vent system of claim 46, wherein the third baffles each have an outwardly facing generally concave configuration.

49. The ridge vent system of claim 46, wherein the third baffles are arranged in a generally sinusoidal pattern on each panel.

50. A ridge vent system mounted over an opening formed in a peak of a roof, the ridge vent system comprising:

at least a first ridge vent member and a second ridge vent member connected with one another, the first and second ridge vent members each including:

an elongated panel having a first end and a second end and a pair of opposed sides;

the panel including an upper surface and a lower surface, the lower surface facing toward the roof;

a plurality of first baffles depending from the lower surface of the panel, the first baffles being spaced from one another and arranged to form a pair of first rows adjacent the sides of the panel;

a plurality of second baffles depending from the lower surface of the panel, the second baffles being spaced from one another and arranged to form a pair of second rows disposed adjacent the first rows, the second baffles alternating with and at least partially overlapping the first baffles along each side of the panel, the first and second baffles being spaced from one another to provide a plurality of drainage spaces between the first and second baffles, the second rows being disposed between the first rows;

the first end including a first lug having a generally triangular socket with a constricted throat;

the second end including at least a first generally triangular dowel;

the first dowel of the first ridge vent member being received in the first socket of the second ridge vent member to securely inter-engage the first and second ridge vent members;

each panel being formed with a plurality of apertures adjacent the second baffles; and wherein the first and second ridge vent members each further include a pair of lips extending outwardly from the sides of each panel and being oriented at an angle of about 10° to 60° with respect to the upper surface of the panel.

51. A ridge vent system mounted over an opening formed in a peak of a roof, the ridge vent system comprising:

at least a first ridge vent member and a second ridge vent member connected with one another, the first and second ridge vent members each including:

an elongated panel having a first end and a second end and a pair of opposed sides;

the panel including an upper surface and a lower surface, the lower surface facing toward the roof;

a plurality of first baffles depending from the lower surface of the panel, the first baffles being spaced from one another and arranged to form a pair of first rows adjacent the sides of the panel;

a plurality of second baffles depending from the lower surface of the panel, the second baffles being spaced from one another and arranged to form a pair of second rows disposed adjacent the first rows, the second baffles alternating with and at least partially overlapping the first baffles along each side of the panel, the first and second baffles being spaced from one another to provide a plurality of drainage spaces between the first and second baffles, the second rows being disposed between the first rows;

the first end including a first lug having a generally triangular socket with a constricted throat;

the second end including at least a first generally triangular dowel;

the first dowel of the first ridge vent member being received in the first socket of the second ridge vent member to securely inter-engage the first and second ridge vent members; and wherein each ridge vent member further includes a flap extending outwardly from the first end, each panel being formed with a recess adjacent the second end, the flap of the first ridge vent member being overlappingly received in the recess of the second ridge vent member.

52. A ridge vent system mounted over an opening formed in a peak of a roof; the ridge vent system comprising:

at least a first ridge vent member and a second ridge vent member connected with one another, the first and second ridge vent members each including:

an elongated panel having a first end and a second end and a pair of opposed sides;

the panel including an upper surface and a lower surface, the lower surface toward the roof;

a plurality of first baffles depending from the lower surface of the panel, the first baffles being spaced from one another and arranged to form a pair of first rows adjacent the sides of the panel;

a plurality of a second baffles depending from the lower surface of the panel, the second baffles being spaced from one another and arranged to form a pair of second rows disposed adjacent the first rows, the second baffles alternating with and at least partially overlapping the first baffles along each side of the panel, the first and second baffles being spaced from one another to provide a plurality of drainage spaces between the first and second baffles, the second rows being disposed between the first rows;

the first end including a first lug having a generally triangular socket with a constricted throat;

the second end including at least a first generally triangular dowel;

the first dowel of the first ridge vent member being received in the first socket of the second ridge vent member to securely inter-engage the first and second ridge vent members;

wherein each panel is resiliently deformable about a longitudinal axis between a relaxed position and an installed position, the panels in the installed position being structured to conform to the shape of the roof; and a pair of seal members depending from the lower surface of each panel at the ends of the panel, each seal member including at least a pair of seal plates that at least partially overlap one another when the panel is in the relaxed position, the first dowels of each of the first and second ridge vent members being formed in one of the seal members of each of the first and second ridge vent members, and the first sockets of each of the first and second ridge vent members being formed in the other of the seal members of each of the first and second ridge vent members.

53. The ridge vent system of claim 46, wherein each ridge vent member was resiliently deformed lengthwise in the form of a roll prior to installation on the roof.

54. The ridge vent system of claim 46, wherein the first and second baffles are generally V-shaped.

* * * * *

UNITED STATES PATENT AND TRADEMARK OFFICE

CERTIFICATE OF CORRECTION

PATENT NO. : 6,684,581 B2
DATED : February 3, 2004
INVENTOR(S) : Larry D. Robinson et al.

It is certified that error appears in the above-identified patent and that said Letters Patent is hereby corrected as shown below:

Column 10,
Line 9, “filly” should read -- fully --.

Column 11,
Line 10, “to-be” should read -- to be --.

Column 15,
Line 19, insert -- the -- prior to “panel”.
Line 46, after “another” insert -- portion --.

Column 17,
Line 49, “a” should read -- at --.

Column 18,
Line 12, insert -- having -- prior to “a pair…”.

Column 24,
Line 14, insert -- facing -- after “surface”.

Signed and Sealed this

Eleventh Day of January, 2005

JON W. DUDAS
*Director of the United States Patent and Trademark Office*